US008517637B2

(12) United States Patent
Thomas et al.

(10) Patent No.: US 8,517,637 B2
(45) Date of Patent: Aug. 27, 2013

(54) STRUCTURE FOR THE TRANSPORT, INSTALLATION AND DISMANTLING OF AN OIL RIG DECK AND METHOD FOR USING ONE SUCH STRUCTURE

(75) Inventors: Pierre Armand Thomas, Puteaux (FR); Jean-Marc Cholley, Taverny (FR)

(73) Assignee: Technip France (FR)

( * ) Notice: Subject to any disclaimer, the term of this patent is extended or adjusted under 35 U.S.C. 154(b) by 258 days.

(21) Appl. No.: 12/515,776

(22) PCT Filed: Nov. 20, 2007

(86) PCT No.: PCT/FR2007/001904

§ 371 (c)(1), (2), (4) Date: Aug. 17, 2009

(87) PCT Pub. No.: WO2008/071861

PCT Pub. Date: Jun. 19, 2008

(65) Prior Publication Data

US 2009/0324342 A1 Dec. 31, 2009

(30) Foreign Application Priority Data

Nov. 22, 2006 (FR) ..... 06 10235
Oct. 9, 2007 (FR) ..... 07 58163

(51) Int. Cl.
*B63B 35/00* (2006.01)

(52) U.S. Cl.
USPC ..... 405/209; 405/204; 405/198; 405/196

(58) Field of Classification Search
USPC ..... 405/195.1, 196, 197, 198, 199, 200, 405/203, 204, 205, 206, 208, 209
See application file for complete search history.

(56) References Cited

U.S. PATENT DOCUMENTS

| | | | | |
|---|---|---|---|---|
| 4,556,004 | A | 12/1985 | Lamy et al. | |
| 4,826,355 | A * | 5/1989 | Marion | 405/209 |
| 5,829,919 | A * | 11/1998 | Heerema | 405/209 |
| 6,171,028 | B1 * | 1/2001 | Van Gelder | 405/209 |
| 6,293,734 | B1 * | 9/2001 | Thomas et al. | 405/209 |
| 6,347,909 | B1 * | 2/2002 | Kocaman | 405/209 |
| 6,840,713 | B1 * | 1/2005 | Schia et al. | 405/209 |
| 7,465,126 | B2 * | 12/2008 | Werners et al. | 405/204 |
| 2005/0013667 | A1 * | 1/2005 | Thomas | 405/209 |
| 2005/0158125 | A1 | 7/2005 | Thomas et al. | |

FOREIGN PATENT DOCUMENTS

| | | |
|---|---|---|
| FR | 2 514 317 A1 | 4/1983 |
| FR | A-2 837 461 | 9/2003 |
| GB | 2 363 814 A | 1/2002 |
| WO | WO 00/27693 A | 5/2000 |

OTHER PUBLICATIONS

International Search Report dated May 28, 2008, issued in corresponding international application No. PCT/FR2007/001904.

* cited by examiner

*Primary Examiner* — Frederick L Lagman
(74) *Attorney, Agent, or Firm* — Ostrolenk Faber LLP

(57) ABSTRACT

The invention relates to a structure for the transport, installation and dismantling of an oil rig deck, of the type comprising a floating hull provided with legs which can move vertically in relation to the buoyant hull and a shuttle associated with each of said legs and intended to be applied against the lower face of the deck, whereby said shuttle can be moved by the corresponding leg between a low position on the buoyant hull and a high rig deck lifting position.

22 Claims, 14 Drawing Sheets

STRUCTURE FOR THE TRANSPORT, INSTALLATION AND DISMANTLING OF AN OIL RIG DECK AND METHOD FOR USING ONE SUCH STRUCTURE

CROSS REFERENCE TO RELATED APPLICATIONS

The present application is a 35 U.S.C. §371 National Phase conversion of PCT/FR2007/001904, filed Nov. 20, 2007, which claims benefit of French Application No. 06 10235, filed Nov. 22, 2006, and French Application No. 07 58163, filed Oct. 9, 2007, the disclosures of which are incorporated herein by reference. The PCT International Application was published in the French language.

BACKGROUND OF THE INVENTION

This invention relates to a structure for the transport, installation and dismantling of an offshore oil rig deck.

This invention relates to a process for the transport, installation and dismantling of an offshore oil rig deck.

In the extraction of oil it is known that an oil rig which comprises a deck bearing in particular operating equipment and accommodation is positioned above an oilfield.

The deck is supported by a supporting assembly comprising legs which bear against the sea bed or floating columns anchored to the sea bed.

Several methods are used to transport, install and dismantle oil rig decks.

One known method comprises using lifting cranes mounted on barges to transfer the rig deck from the transport barge to the supporting assembly. This method, which is the one in most widespread use at the present time, has limitations. The first of these limitations is the lifting capacity of the lifting cranes, which may make it necessary to construct the deck in several sections, significantly increasing the manufacturing cost of the deck and the cost of installing and dismantling the said deck on the oil rig. The second limitation lies in the fact that this method makes it necessary to have a relatively large favourable weather window in order to be able to carry out this operation at sea under satisfactory conditions.

Another known method comprises installing the oil rig deck as a single block on the supporting assembly by causing it to float. The deck is then placed over the supporting assembly by means of either a ballasting system or a mechanical system.

The main disadvantage of ballasting or deballasting systems lies in the fact that they depend on sea conditions, which makes it difficult to use them in areas where the favourable weather windows are relatively short.

In general the mechanical systems used hitherto to install and dismantle oil rig decks are faster than ballasting or deballasting systems.

Furthermore, a structure for the transport, installation and dismantling of a fixed oil rig deck which comprises a U-shaped floating hull fitted with at least three legs for lifting that hull and designed to bear against the sea bed and a shuttle which can move along the said legs on the hull and intended to be applied to the underside of an oil rig deck is known from FR-A-2 837 461.

Thus when the rig deck is installed or dismantled the legs are lowered to bear against the sea bed and the deck is lifted by the shuttle, which is itself lifted by the hull.

In the case of oilfields in deep water this type of structure cannot be used for the installation or dismantling of an oil rig deck because the legs have to be in contact with the bottom in order to lift the deck, which is impossible in the case of such fields.

SUMMARY OF THE INVENTION

The object of the invention is to overcome these disadvantages by providing a structure which can be used for the transport, installation or dismantling of a fixed or floating oil rig, in both shallow water and deep water.

For this purpose, the invention relates to a structure for the transport, installation and dismantling of an offshore oil rig deck characterised in that it comprises:

- a floating hull fitted with legs which can move vertically with respect to the hull as it floats, by means of moving mechanisms, and
- associated with each of the said legs, a shuttle which is intended to be applied against the underside of the deck and which can be moved on the corresponding leg between a low position on the floating hull and a high position lifting the rig deck, each shuttle being fitted with means for locking onto the corresponding leg.

According to particular embodiments,

- each movement mechanism comprises two opposing plates mounted on the corresponding leg and each comprising a set of teeth on each lateral surface and also at least two opposing assemblies carried on the hull each comprising a pinion which is driven in rotation and acts together with a set of teeth;
- at each leg the hull comprises means for guiding a corresponding shuttle between the low and high positions respectively,
- each shuttle is formed of a body comprising a vertical limb extending substantially parallel to the corresponding leg and provided at the top with a plate which extends substantially perpendicularly to the said limb and comprises an opening having a cross-section of a shape matching the transverse cross-section of the leg and also, at the bottom, a horizontal bearing plate supporting the deck,
- locking means are mounted on the plate of each shuttle,
- the locking means for each shuttle comprise at least one opposing rack which can be moved by at least one operating system between a retracted position and a locking position in which it engages one of the sets of teeth on the corresponding leg,
- the guide means for the shuttle on each leg comprise two columns extending substantially parallel to the corresponding leg and two passages made in the bearing plate of the said shuttle, each passage having a cross-section matching the transverse cross-section of the corresponding column,
- the hull is generally U-shaped,
- the U-shaped floating hull comprises two opposite and parallel side limbs each of which bear at least one leg and are connected together through a central limb,
- the two side limbs and the central limb float,
- the length of the central limb can be adjusted according to the width of the deck,
- the two side limbs comprise two floats and the central limb comprises a transverse beam supported by the said side limbs which can slide on the said beam, according to the width of the deck.

The open part of the hull comprises a gate formed of two opposing sections of beam which can each slide on a float between an open position to position at least one supporting column beneath the deck and a closed position while the said deck is being transported.

The invention also relates to a process for the transport and installation of an oil rig deck to its work site, characterised in that it comprises the following stages:

through the use of floating transport means, bringing the rig deck into the vicinity of a floating structure comprising a U-shaped hull fitted with legs which can be moved vertically with respect to the floating hull and shuttles associated with each of the legs which can be moved on the corresponding leg, placing the floating structure beneath the deck, lowering the legs, locking each shuttle to the corresponding leg, placing the deck on the shuttles and removing the transport means, lifting the deck through the shuttles and the legs while the hull remains afloat;

moving the structure supporting the deck to bring the deck above its support, lowering the shuttles by the legs in order to place the deck on its support, lowering the legs and the shuttles to release the deck from the structure, and removing the structure from the work site.

The invention also relates to a process for the dismantling and transport of an oil rig deck on a work site to floating transport means, characterised in that it comprises the following stages:

bringing a floating structure comprising a U-shaped hull fitted with legs which can move vertically with respect to the floating hull and shuttles associated with each of the legs which can be moved on the corresponding leg, to the work site, lowering the legs, locking each shuttle on the corresponding leg, lifting the deck from its support through the shuttles and the legs, while the hull remains afloat, moving the structure supporting the deck to remove the deck from its support, placing transport means within the structure and below the deck, lowering the shuttles through the legs to place the deck on the transport means, lowering the legs and the shuttles to release the deck from the structure, and removing the deck from the structure by the transport means.

BRIEF DESCRIPTION OF THE DRAWINGS

The invention will be better understood from a reading of the following description provided purely by way of example with reference to the appended drawings, in which.

DESCRIPTION OF PREFERRED EMBODIMENTS

In general the invention applies to all types of fixed or floating oil rigs in shallow or deep water.

In what follows the description will be provided with respect to a floating platform for oil extraction in deep water.

Figure 1:
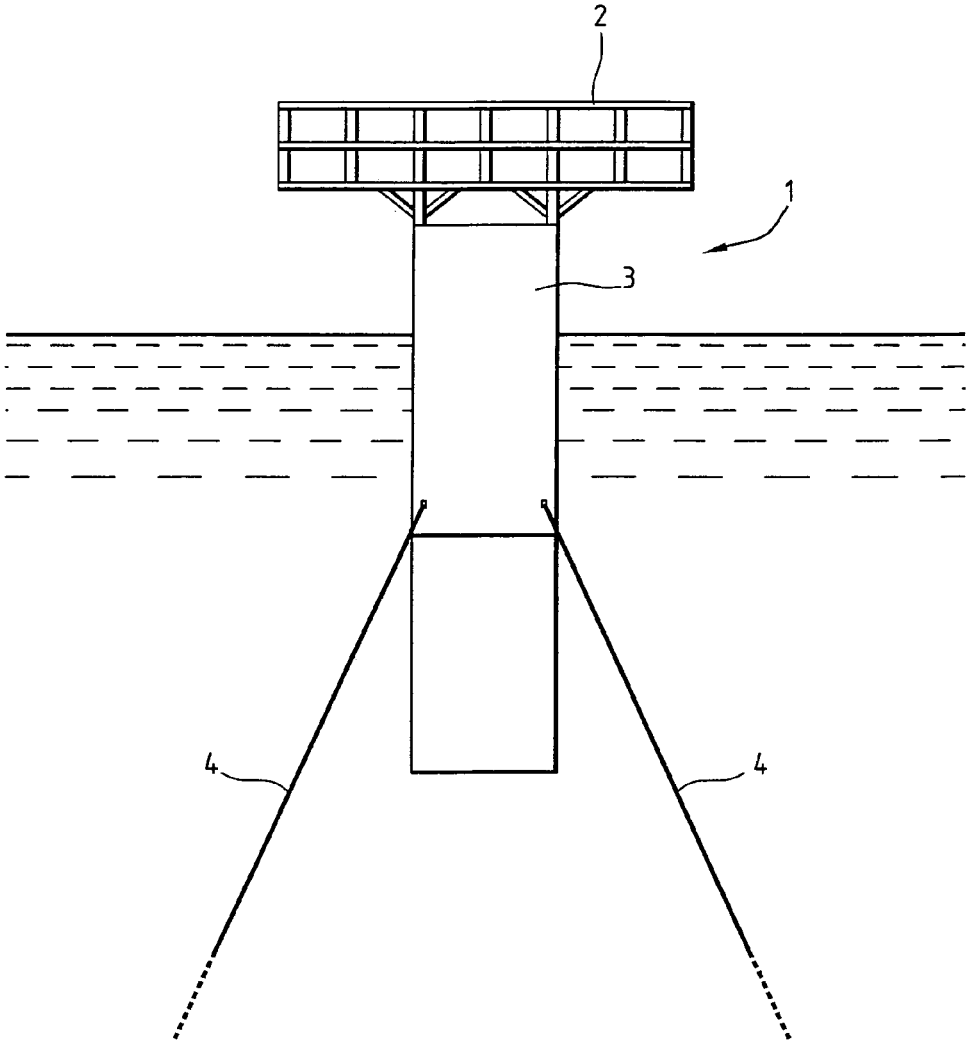
FIG. 1 is a diagrammatical view in elevation of a floating oil rig in its working position.

FIG. 1 shows diagrammatically a floating oil rig indicated as a whole by the reference numeral 1 which conventionally comprises a deck 2 provided with normal operating equipment and accommodation. This deck 2 is mounted on a supporting column 3 forming a float which is secured to the sea bed, not shown, by anchor lines 4.

Figure 2:
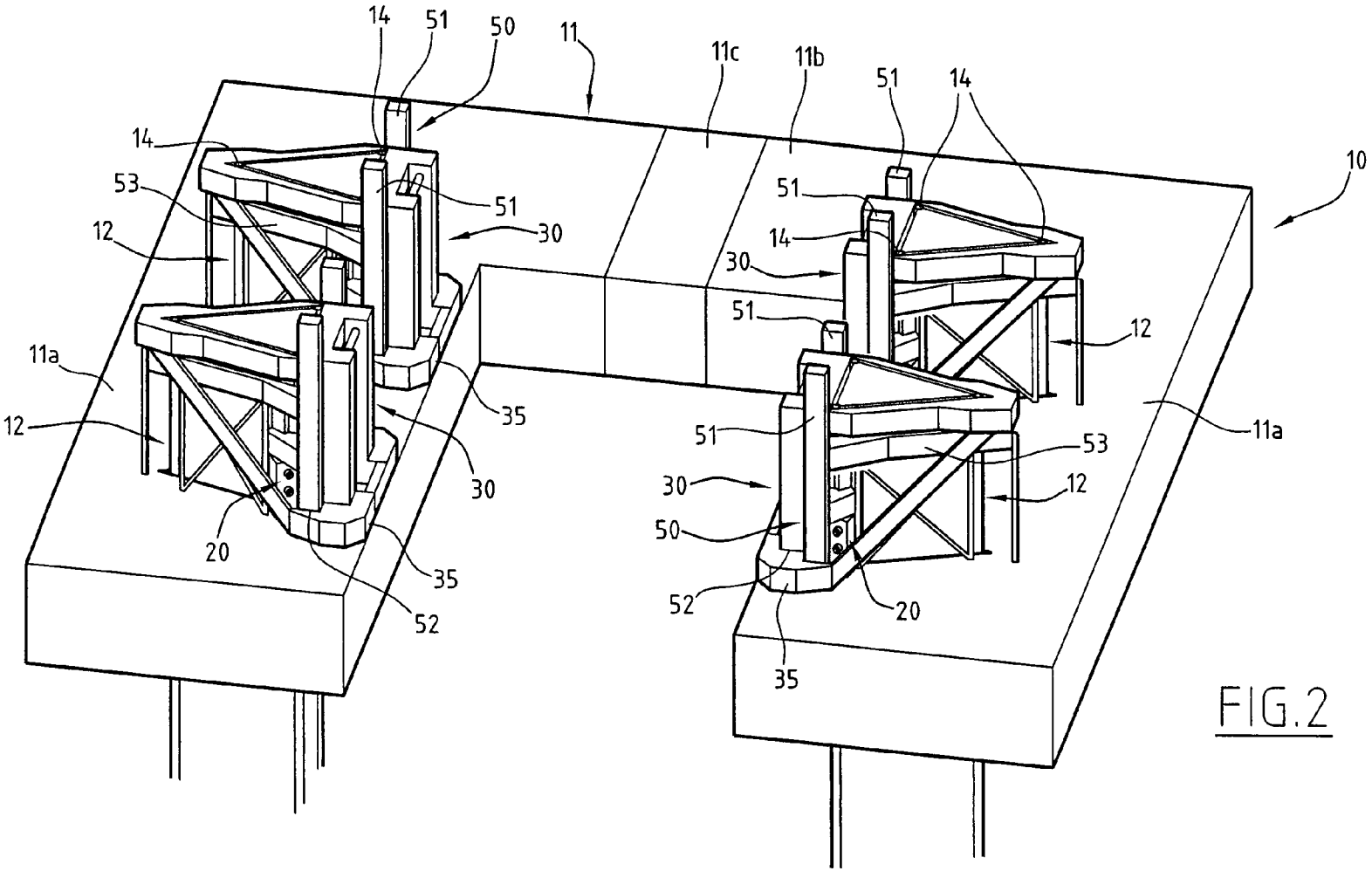
FIGS. 2 and 3 are diagrammatical perspective views of a structure for transport, installation and dismantling according to the invention in the position receiving the deck of the oil rig and in the position in which the deck is installed respectively.
Figure 3:
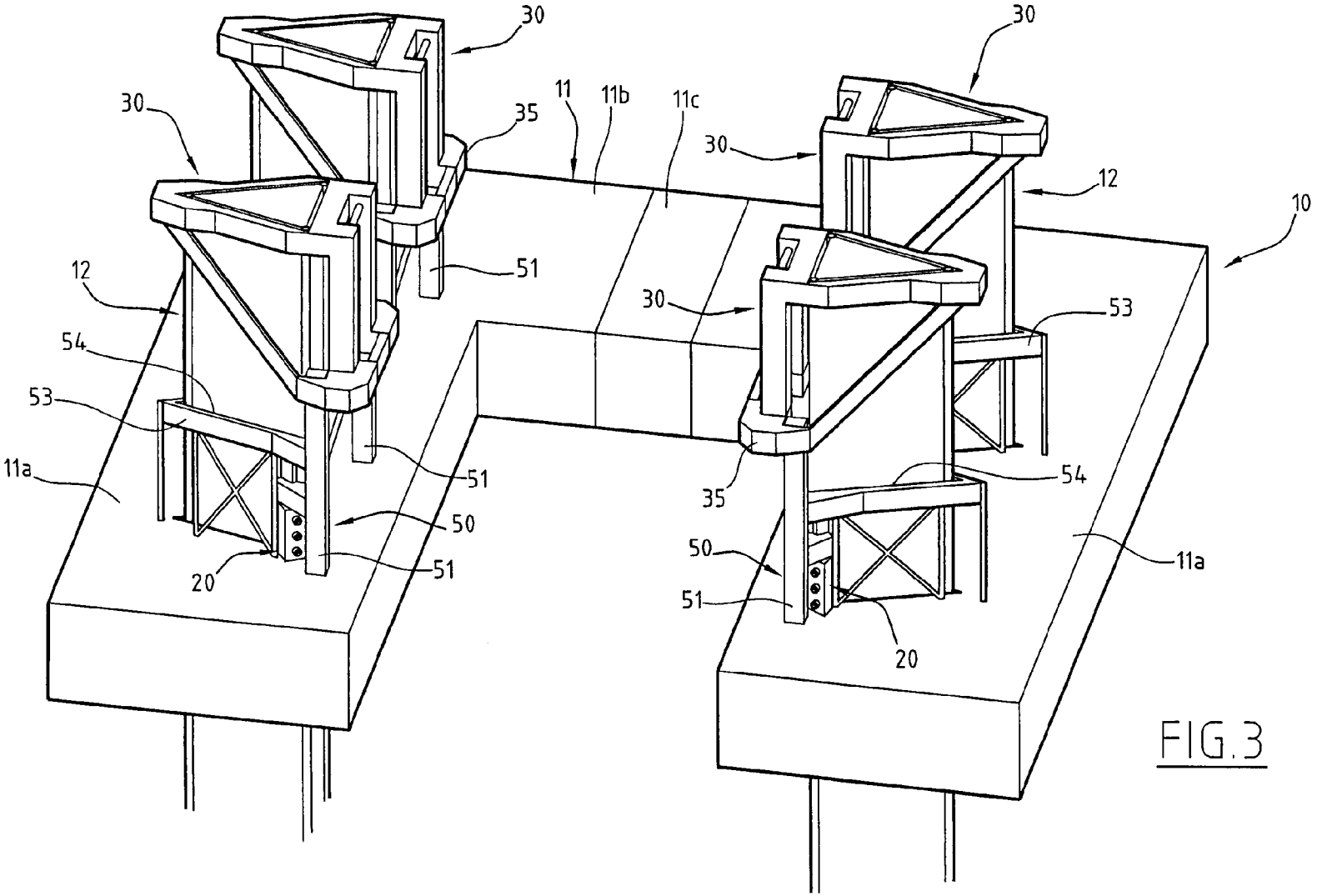

A structure indicated by the general reference 10 and illustrated in FIGS. 2 and 3 is used to effect the transport, installation (commissioning) and dismantling (decommissioning) of deck 2 of oil rig 1 from transport means 5 (FIG. 8A), such as a barge, to support column 3 or vice versa.

In these figures the general dimensions of structure 10 and the proportions between the various components comprising that structure have not necessarily been respected in order to simplify understanding of the drawing.

In general, structure 10 comprises a U-shaped floating hull 11 comprising two opposing parallel side limbs 11*a* connected together by a central limb 11*b*. The two side limbs 11*a* and central limb 11*b* float. Hull 11 is fitted with legs 12 which can move vertically with respect to that hull 11 when afloat. In the embodiment illustrated in FIGS. 2 and 3, hull 11 has four legs 12 located in pairs on each side limb 11*a* of said hull 11.

Figure 5:
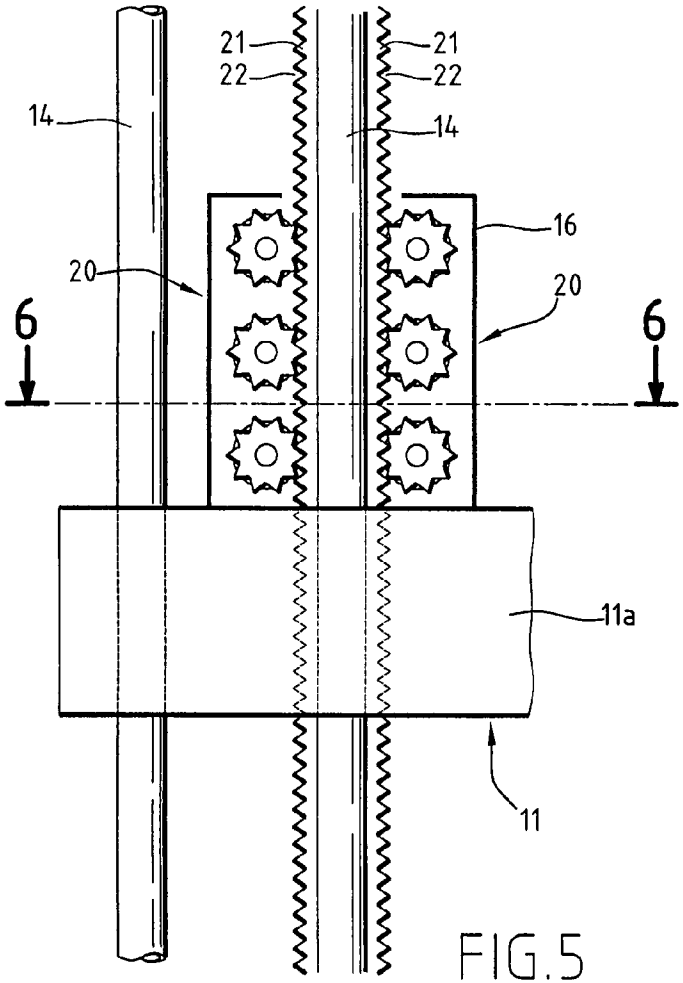
FIG. 5 is a partial view in vertical cross-section of the mechanical means for moving a leg of the structure.

As shown in FIGS. 2, 3 and 5, in this embodiment each of legs 12 has a triangular cross-section. These legs 12 may also have a square or circular cross-section.

Each leg 12 is conventionally formed of three booms 14 connected together by a lattice of metal struts 15 (FIG. 6) and associated with mechanical means imparting movement designated by general reference 20 (FIGS. 2, 3 and 5) for each leg 12. Mechanical means 20 imparting movement are housed in a loadbearing framework 16 (FIG. 5), also known to those skilled in the art as a "jack-house", which is supported by hull 11.

Figure 6:
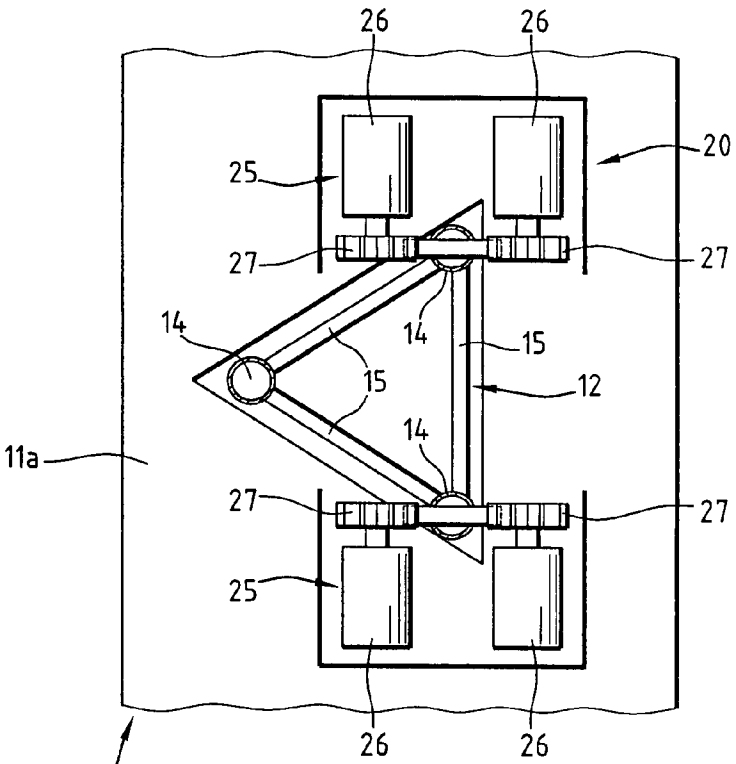
FIG. 6 is a view in cross-section along the line 5-5 in FIG. 5.

As illustrated in FIGS. 5 and 6, mechanical means 20 for moving each leg 12 comprise two opposing plates 21 each mounted on a boom 14 of corresponding leg 12 and each have on each side face a set of teeth 22 forming a double rack on the two beams 14. Mechanical means 20 imparting movement also comprise a number of assemblies 25 located on either side of each plate 21, according to the height of the latter. Each assembly 25 comprises a motor and gearbox unit 26 driving a pinion 27 which engages a set of teeth 22 in corresponding plate 21. In the embodiment illustrated in FIGS. 4 and 5 the two sets of teeth 22 on each plate 21 are associated with six pinions 27 each caused to rotate by a motor and gearbox unit 26.

Structure 10 also has in association with each of legs 12 a shuttle indicated by general reference 30 which can move on corresponding leg 12 between a low position bearing on floating hull 11, as shown in FIG. 2, and a high position, as shown in FIG. 3. Shuttles 30 associated with legs 12 are moved simultaneously by legs 12.

Figure 4:
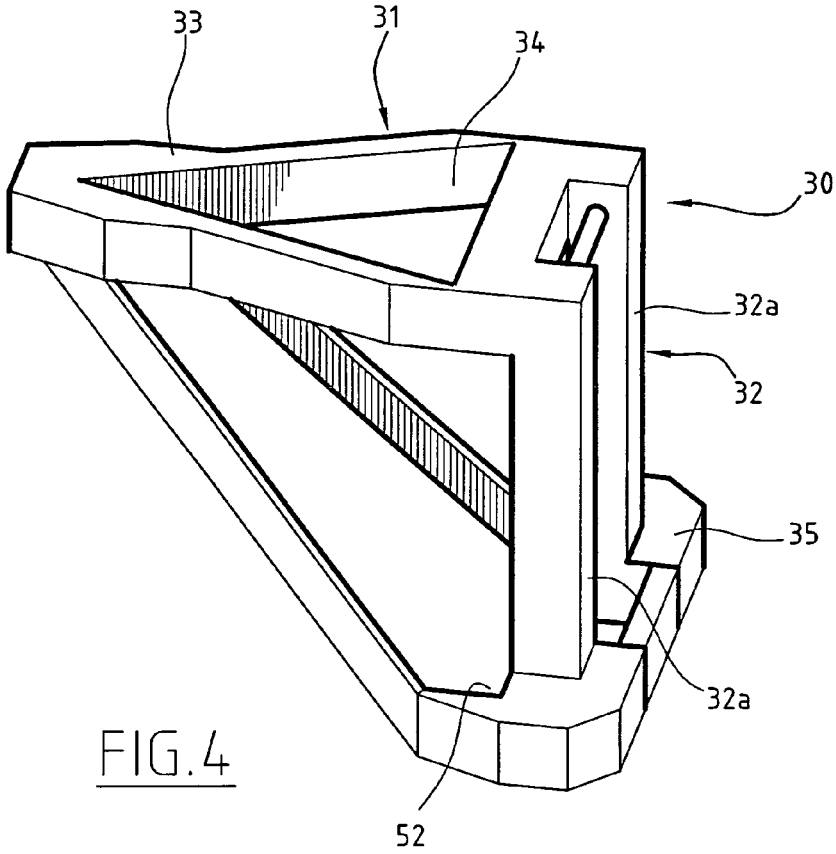
FIG. 4 is a diagrammatical perspective view of a shuttle for the structure.

As illustrated in FIG. 4, each shuttle 30 comprises a body 31 having a vertical limb 32 extending substantially parallel to booms 14 of corresponding leg 12. In the embodiment illustrated in FIGS. 2 to 4, vertical limb 32 comprises two vertical parallel beams 32*a*.

Limb 32 is provided at the top with a plate 33 extending substantially perpendicular to said limb 32 and also at the bottom a horizontal bearing plate 35 supporting deck 2 of platform 1, as will be seen below.

Plate 33 comprises an opening 34 having a cross-section of shape matching the transverse cross-section of corresponding leg 12, in this particular case a triangular cross-section. Plate 33 is connected to bearing plate 35 by stiffening struts 36.

Each shuttle 30 is provided with means 40 for locking onto corresponding leg 12.

Figure 7:
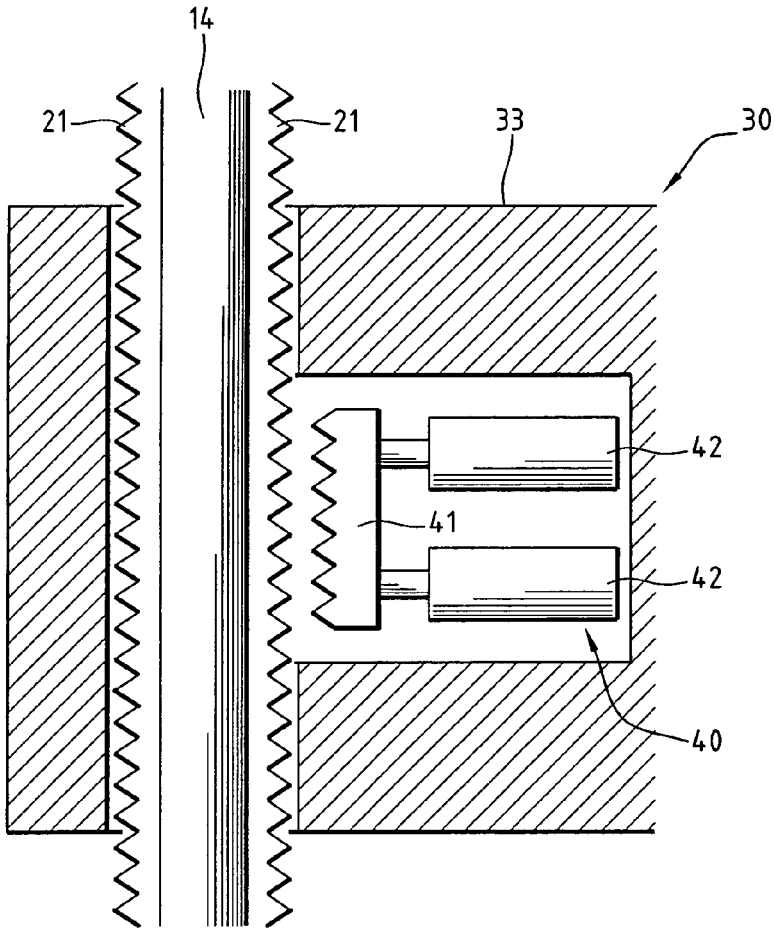
FIG. 7 is a diagrammatical view in vertical cross-section of the means for locking a shuttle onto a leg of the structure according to the invention.

These locking means 40, which are illustrated in greater detail in FIG. 7, comprise at least one opposing rack 41 and preferably at least one opposing rack 41 for each plate 21. Opposing rack 41 can be moved by means of at least one drive member 42 and preferably by two drive members 42 comprising for example hydraulic or pneumatic jacks so as to move opposing rack 41 between a retracted position and a locking position in which it engages one of the sets of teeth 22 on corresponding leg 12. The assembly comprising opposing rack 41 and drive means 42 is mounted on plate 33 on each shuttle 30.

Finally, at each leg 12 hull 11 has means 50 for guiding corresponding shuttle 30 between the low (FIG. 2) and high (FIG. 3) positions respectively.

As illustrated in these FIGS. 2 and 3, guide means 50 for shuttle 30 for each leg 12 comprise two vertical columns 51 extending substantially parallel to corresponding leg 12. Each column 51 acts together with a passage 52 provided in bearing plate 35 of shuttle 12 and each of these passages 52 has a cross-section of shape matching the cross-section of corresponding column 51. The two columns 51 are connected together by means of a connecting plate 53 extending substantially perpendicular to said columns 51, which comprise a central passage 54 (FIG. 3) having a cross-section of a shape matching the transverse cross-section of corresponding leg 12, and in this particular case a triangular cross-section. Connecting plate 53 forms a guide for corresponding leg 12.

While shuttle 30 moves between a low position and a high position on leg 12, bearing plate 35 of shuttle 30 is guided by columns 51 and in the low position illustrated in FIG. 2 plate 31 of shuttle 30 bears against the upper extremity of each column 51.

In a preferred embodiment the length of central limb 11*b* of hull 11 can be adjusted according to the width of deck 2 of oil rig 1. For this purpose this central limb 11*b* may comprise two sections between which one or more intermediate sections 11*c* may be fitted in order to alter the length of this central limb 11*b*.

Deck 2 is transported to and installed on structure 10 at a work site in the following way.

Structure 10 is floated close to the work site with legs 12 raised so as not to slow its movement.

Figure 8A:
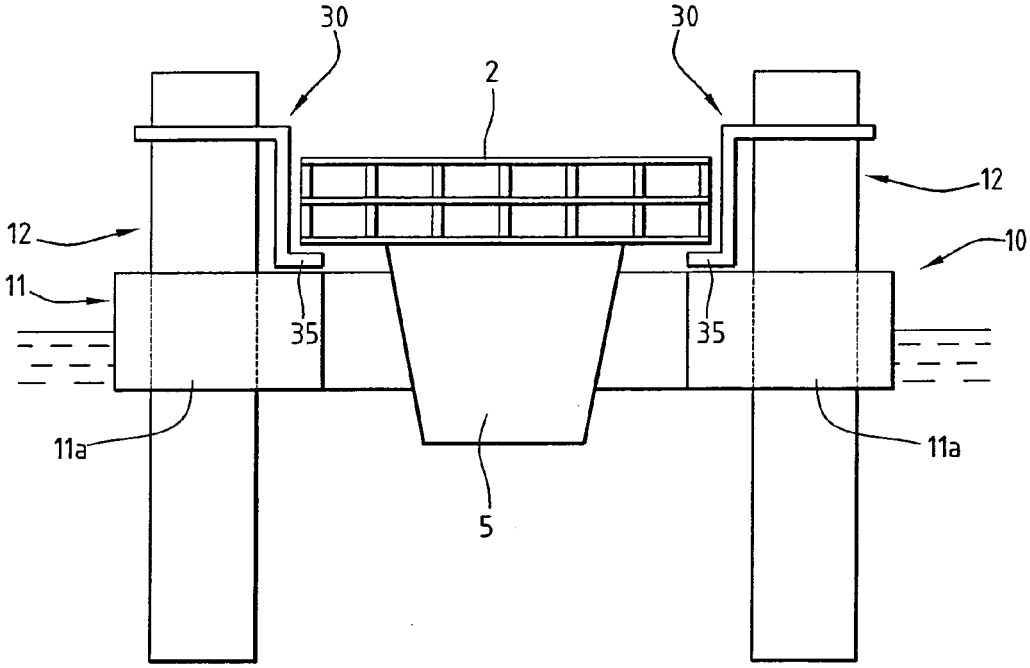
FIGS. 8A to 8E are diagrams showing the various stages in the transport and installation of a rig by the structure according to the invention.
Figure 8B:
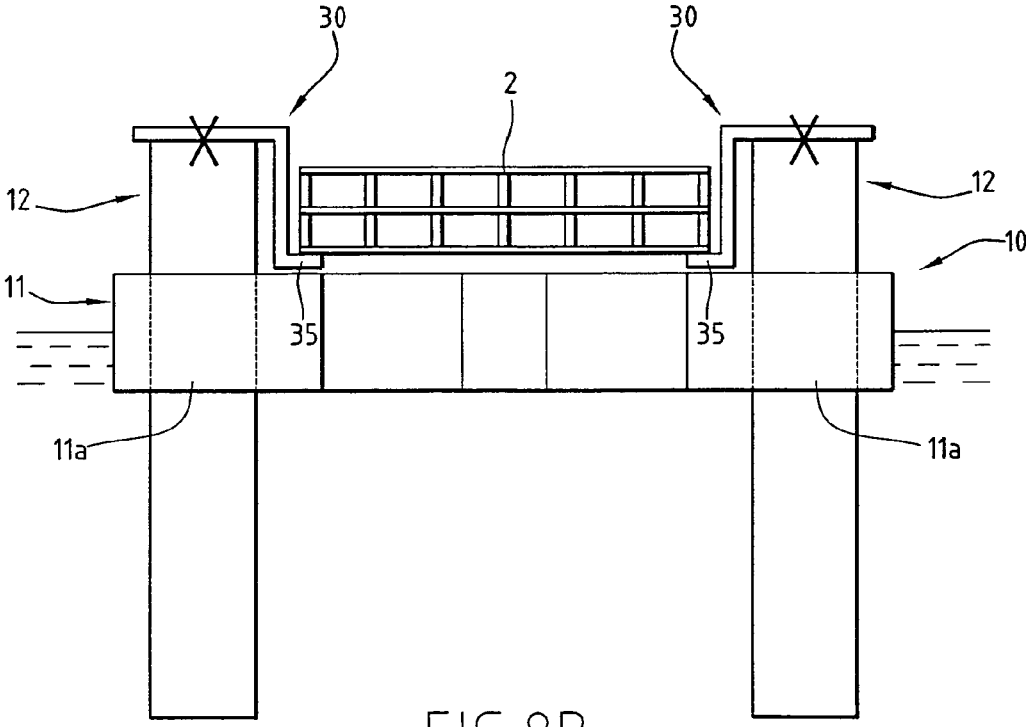

First of all, and as shown in FIG. 8A, floating transport means, such as a barge 5, brings deck 2 of rig 1 close to floating structure 10. Barge 5 is positioned between the two side limbs 11*a* of hull 1, legs 12 of that hull 11 being in an intermediate position or in a fully raised position.

Then these legs 11 are lowered and each shuttle 30 is locked to corresponding leg 12 according to the height of the lift, but preferably to the top extremity of the said leg. Shuttles 30 are locked onto legs 12 by operating jacks 42 so that opposing racks 41 engage adjacent teeth 22.

Deck 2 is placed on the bearing plates 35 of shuttles 30 by ballasting barge 5 and barge 5 is then removed. Where barge 5 does not have a ballasting system, shuttles 30 are locked to legs 12 and legs 12 are raised in order to lift deck 2 off barge 5.

Figure 8C:
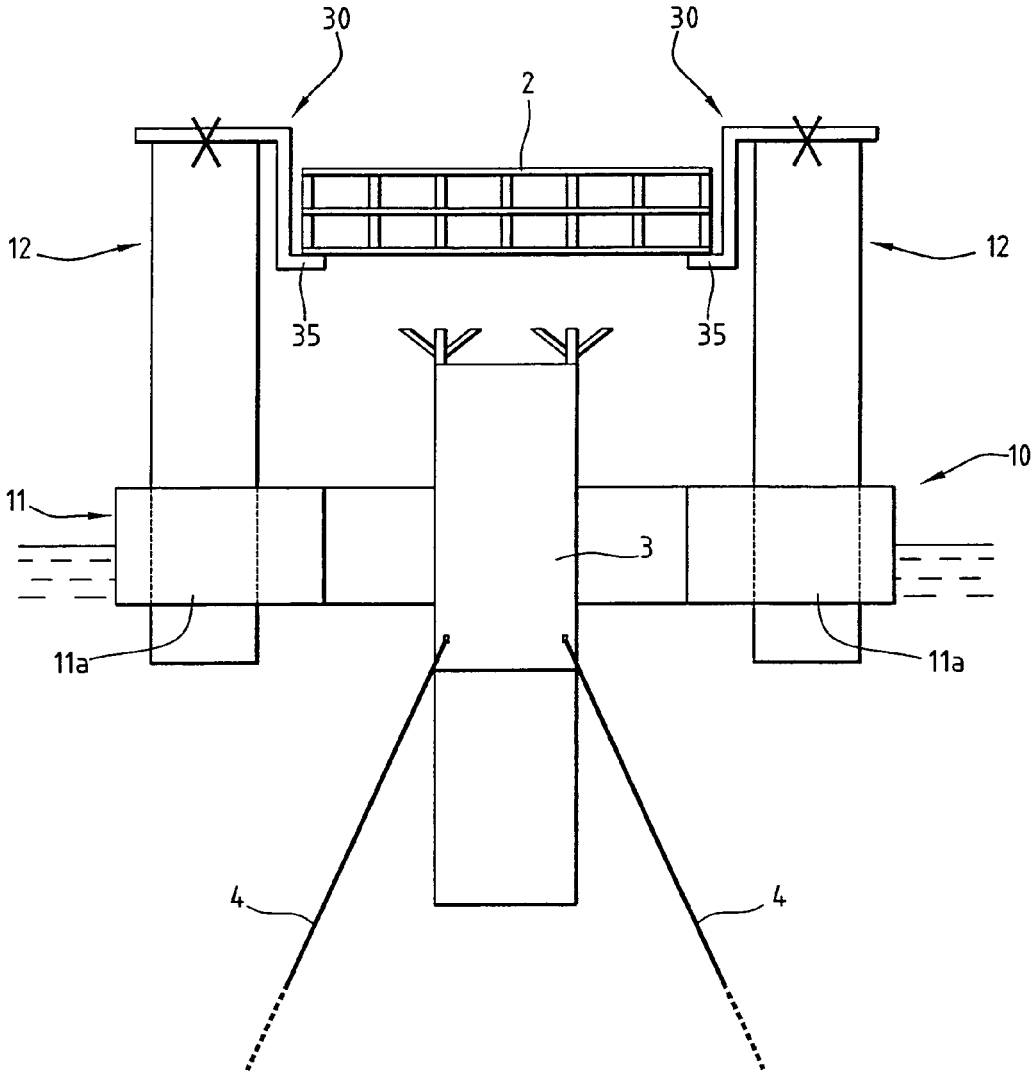

Deck 2 is lifted by shuttles 30 and legs 12, while hull 11 of structure 10 remains afloat. In order to do this motor and gearbox units 26 are operated to drive pinions 27 which engage sets of teeth 22 on plates 21 on each leg 12 to move shuttles 30 into a high lifting position for deck 2 by means of legs 12, as shown in FIG. 8C. As legs 12 are moved to raise deck 2 by means of shuttles 30, each shuttle 30 is guided by columns 51 which slide in passages 52. These columns 51 also make it possible to maintain bearing plates 35 in a substantially horizontal position and prevent shuttles 30 from tipping under the weight of deck 2. Structure 10 supporting deck 2 is moved in order to bring deck 2 above its support comprising supporting column 3.

Figure 8D:
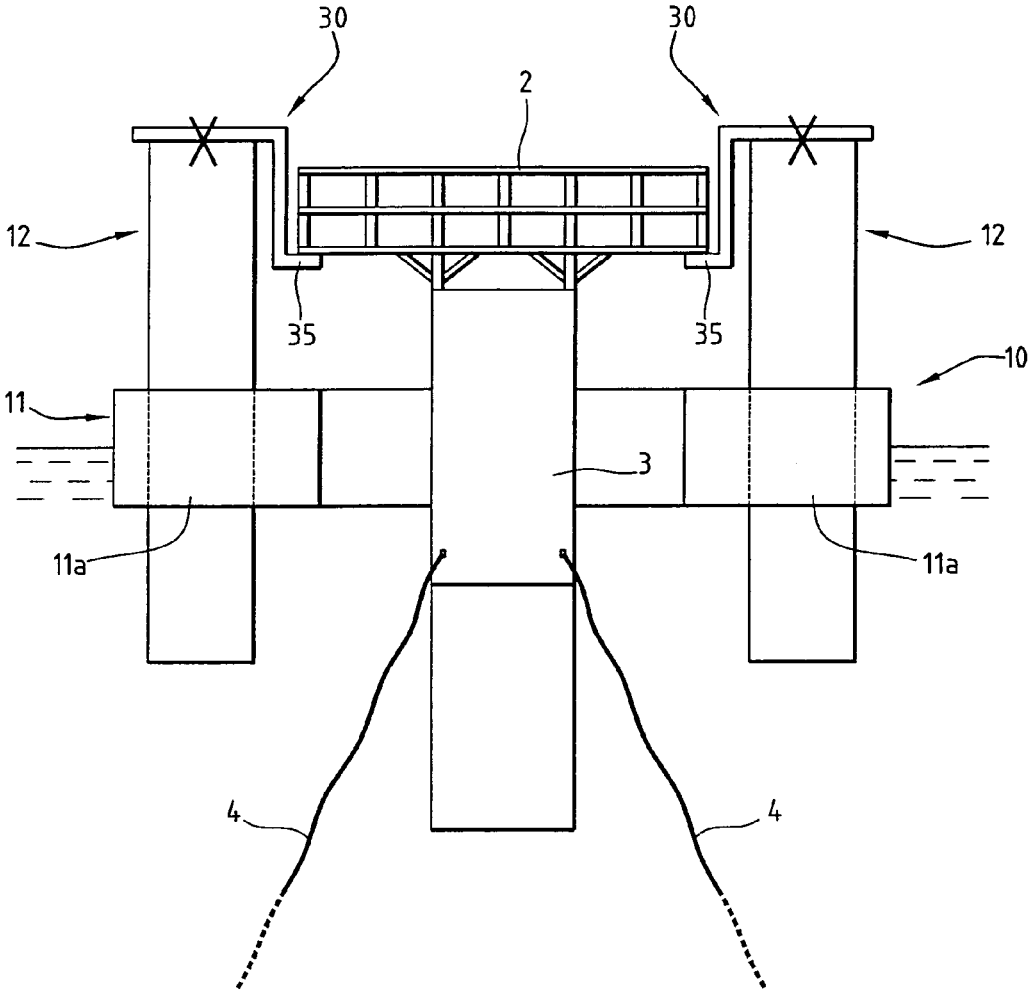

Shuttles 30 are lowered by means of legs 12 to place deck 2 on supporting column 3, as shown in FIG. 8D. In order to perform this operation motor and gearbox units 26 are operated in reverse to cause pinions 27 to rotate and lower legs 12.

In the course of positioning the deck on supporting column 3 (FIGS. 8D and 8E), this supporting column 3 penetrates deeper into the water because of the weight of deck 2. Legs 12 and shuttles 30 continue to descend so that the weight of deck 2 is wholly taken up by supporting column 3.

Figure 8E:
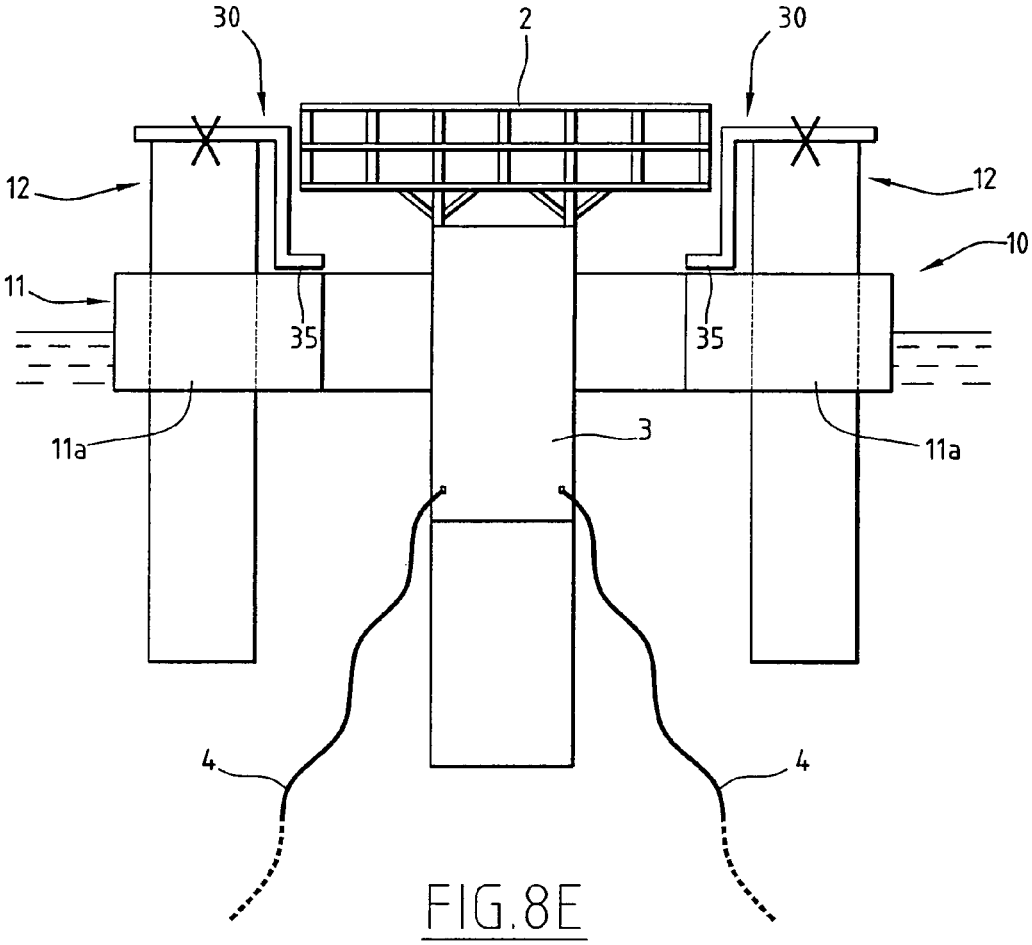

Once deck 2 has been placed on supporting column 3, legs 12 are lowered, with the result that deck 2 can thus be released from structure 10 (FIG. 8E).

Structure 10 is then removed from the work site.

Dismantling and transport of deck 2 from the work site to the transport means comprising barge 5 takes place by performing the operations mentioned briefly above in reverse order.

First of all, hull 11 of floating structure 10 is brought to the work site and legs 12 of that hull 11 are lowered. Shuttles 30 are locked to legs 12 and hull 11 is moved to bring supporting column 3 between side limbs 11*a* of hull 11 and to place shuttles 30 beneath deck 2.

Shuttles 30 are lifted up legs 12 by means of movement mechanisms 20. Bearing plates 35 come into contact with deck 2 and deck 2 is raised, after which floating structure 10 supporting deck 2 is moved to remove deck 2 from supporting column 3. Barge 5 is positioned between side limbs 11*a* of hull 11 beneath deck 2. Through legs 12 shuttles 30 are lowered to place deck 2 on barge 5 and these legs 12 and shuttles 30 are lowered to release deck 2 from structure 10, deck 2 now resting on barge 5.

Barge 5 supporting deck 2 is then removed from structure 10.

Figure 9:
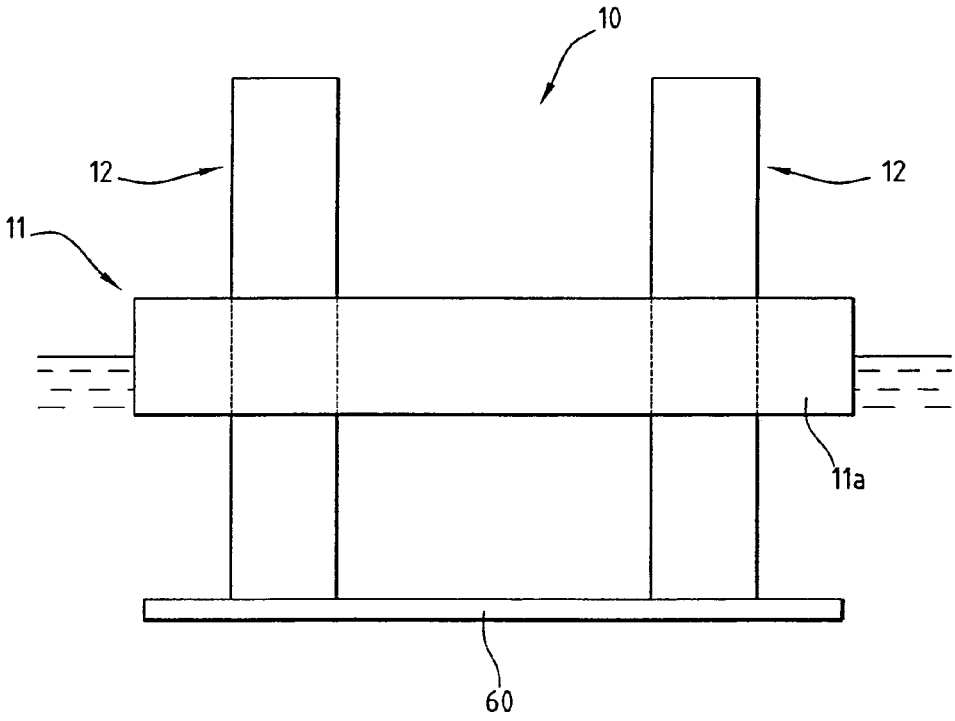
FIG. 9 is a side view of a variant structure.

A variant of structure 10 is illustrated in FIG. 9.

In this embodiment the lower extremities of two adjacent legs 12, that is to say legs on the said side limb 11*a* of hull 60, comprises a stabiliser 60 connecting the two lower extremities together.

Figure 10:
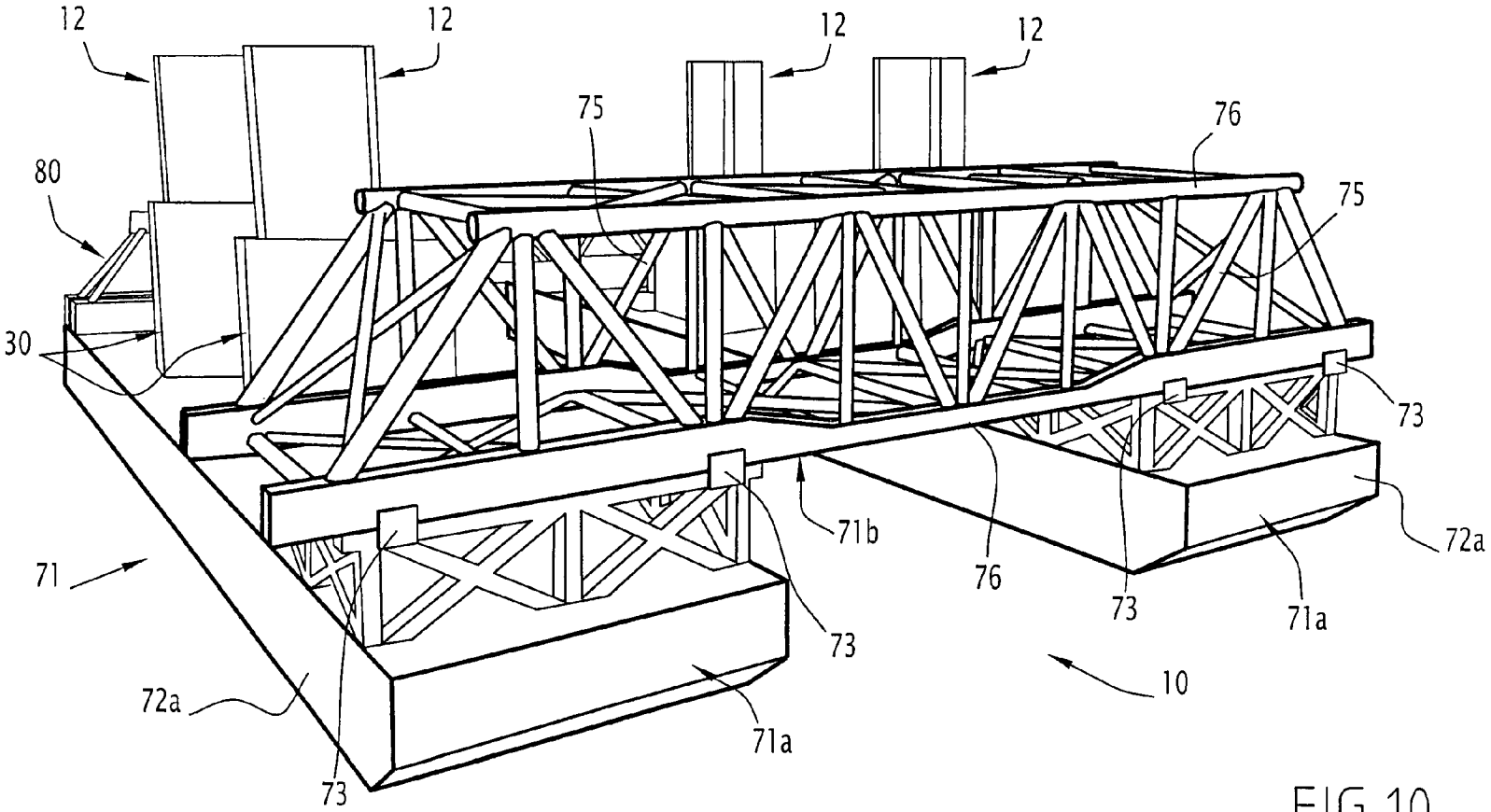
FIG. 10 is a diagrammatical perspective view of a variant of the structure for transport, installation and dismantling according to the invention.
Figure 11:
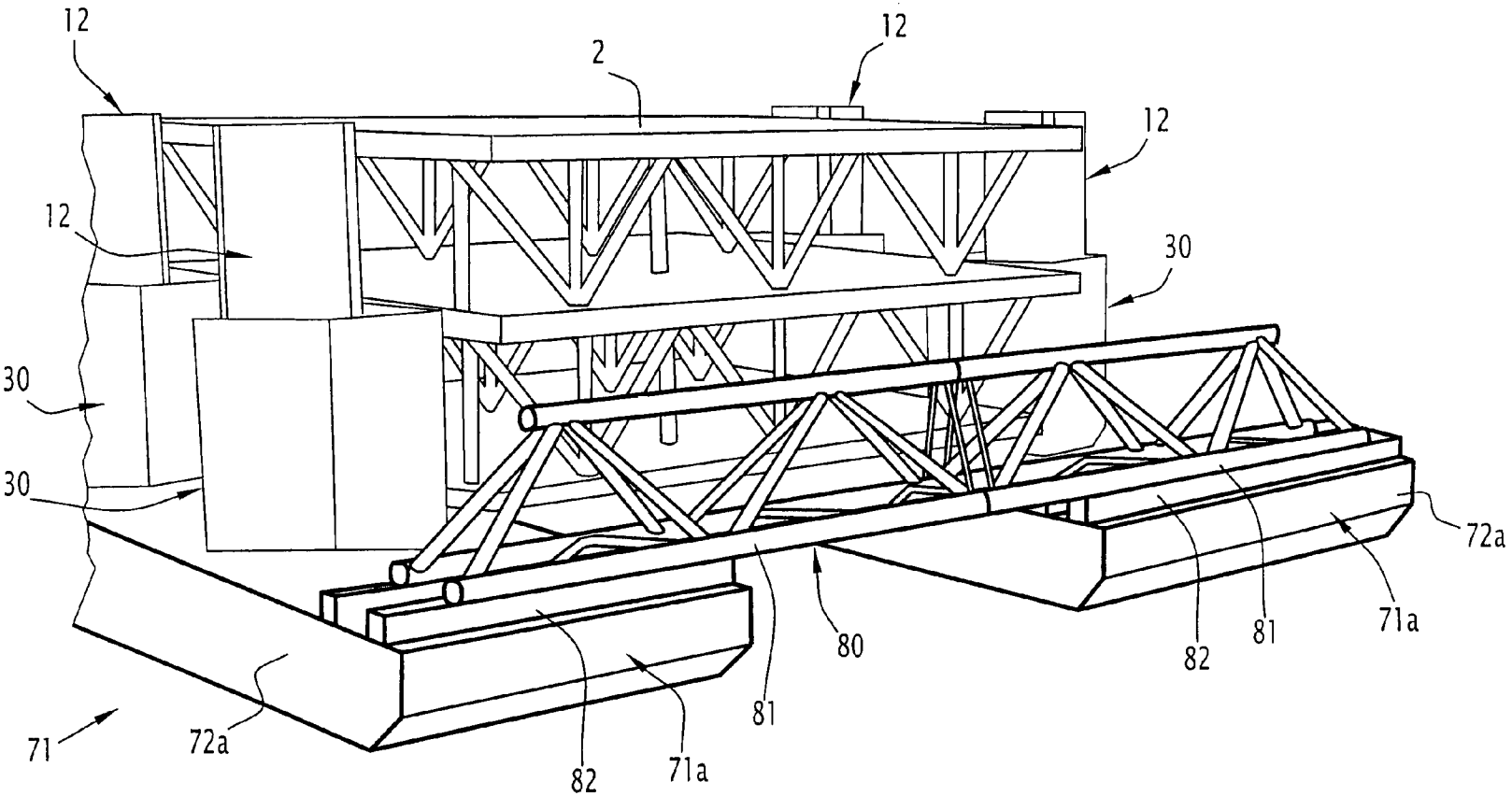
FIGS. 11 and 12 are two diagrammatical perspective views of the structure in FIG. 10 showing the movement of a gate closing off the front part of the structure.

Another variant of structure 10 is illustrated in FIGS. 10 to 11, FIG. 10 showing the rear part of structure 10 and FIGS. 11 and 12 the front part of said structure 10 respectively through which supporting column 3 for deck 2 is inserted, as will be seen below.

In these figures components which are common to the previous embodiment have been indicated by the same reference numbers.

In this embodiment, structure 10 comprises a floating hull 71 which is also generally U-shaped and which has two side limbs 71*a* and a central limb 71*b* connecting the two side limbs 71*a*.

The two side limbs 71*a* are formed from two floats 72*a* extending parallel to each other with a free space between them and central limb 71*b* comprises a transverse beam 72*b* carried by said side limbs 71*a*, as illustrated in FIG. 10. Preferably, transverse beam 72*b* comprises a lattice of tubes 75 connected together by longitudinal members 76.

Side limbs 71*a* of structure 10 can be moved by sliding with respect to each other on transverse beam 72*b* in such a way as to adjust the space between them according to the width of deck 2.

In order to achieve this each float 72*a* forming a side limb 71*a* comprises means 73 for movement on transverse beam 72*b* comprising for example an assembly comprising for example guide rails and a rack and pinion system, which are not shown and are of a known type.

Furthermore, each float 72*a* comprising side limbs 71*a* is provided with means, not shown, for locking onto transverse beam 72*b* in such a way as to maintain the spacing between side limbs 71*a* constant at a particular size.

Figure 12:
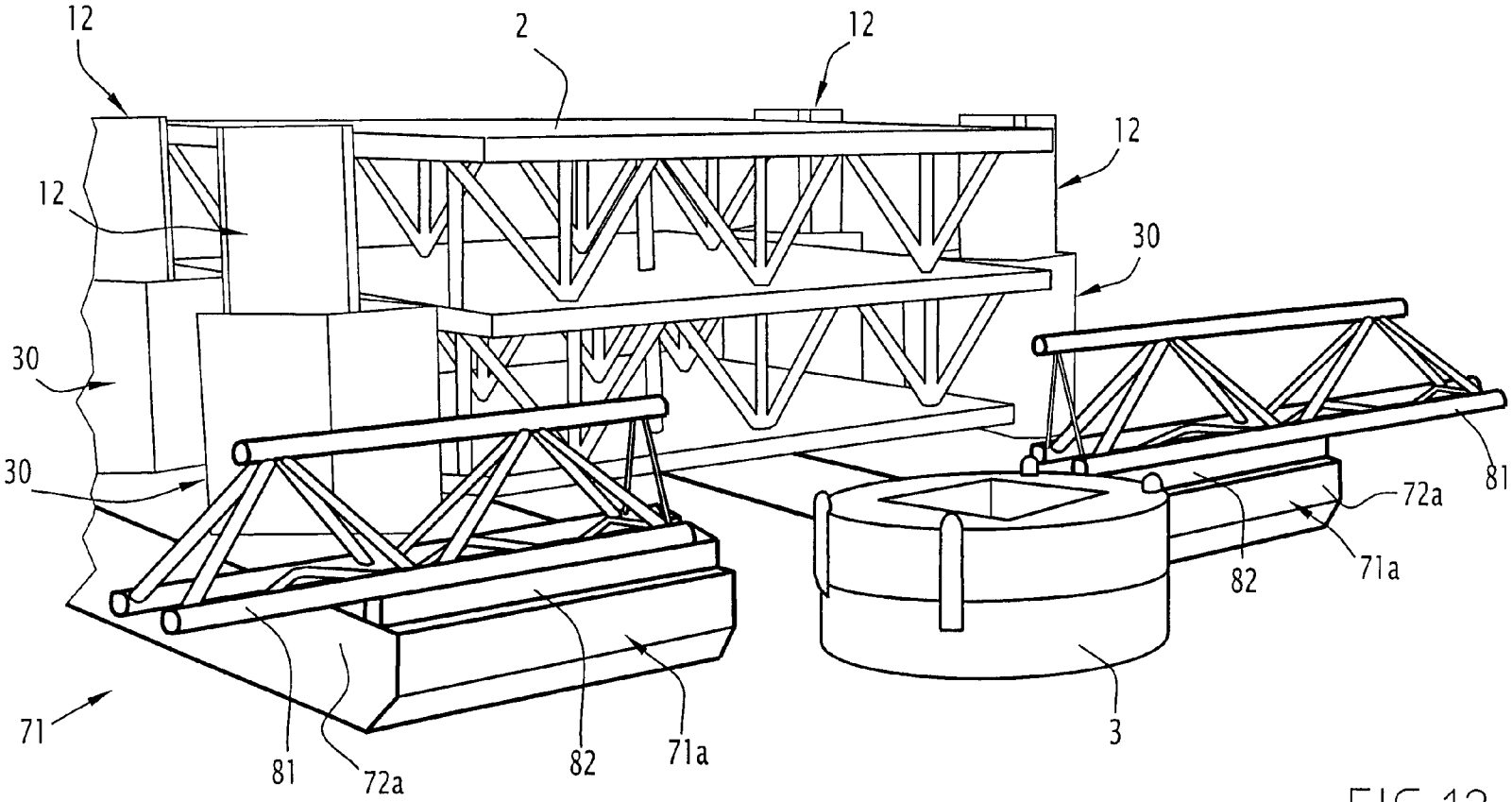

As shown in FIGS. 11 and 12, the open part of hull 71, that is to say opposite central limb 71*b*, comprises a gate indicated as a whole by general reference 80.

This gate 80 comprises two opposing lengths of beam 81 which can move by sliding each upon a float 72*a*.

The two lengths of beam 81 can be moved between a position closing off the entry to structure 10, as shown in FIG. 11 in which they approach and come into contact with each other, and a withdrawn position, as illustrated in FIG. 12, in which they open up the entrance to structure 10 for positioning supporting column 3 beneath deck 2.

In order to do this each float 72*a*, each comprising a side limb 71*a* of hull 71, comprises means 82 for moving each length of beam 81. These means 82 comprise for example an assembly comprising guide bearers and a rack and pinion system or any other means of a known type.

Finally, each float 72*a* also comprises means, not shown, for locking the corresponding length of beam 81 in the closed position or the open position.

As in the preceding embodiment, hull 71 is also fitted with legs 12 which can move vertically with respect to the said hull 71 when afloat by means of movement mechanisms and, in association with each of the said legs a shuttle 30 intended to be applied against the underside of deck 2 which can be moved by corresponding leg 12 between a low position on floating hull 71 and a high position lifting deck 2 of rig 1, each shuttle 30 being provided with means for locking onto corresponding leg 12.

Transport and installation of deck 2, as well as the dismantling of this deck 2 with hull 71, are carried out in the same way as in the previous embodiment except that it is necessary to open and close gate 80 to position deck 2 on shuttles 30 and also to position supporting column 3 beneath deck 2.

In this embodiment hull 11 is provided with rigidity through transverse beam 72*b* forming central limb 71*b* of hull 71 and also by gate 80 in the closed position.

In this closed position of gate 80, the two lengths of beam 81 are locked together by appropriate means, of a known type, not shown.

The two side limbs 71*a* formed by the two floats 72*a* may be disconnected from central limb 71*b*, thus making it possible to reduce the space required to store these limbs.

The structure according to the invention has the advantage that it is capable of transporting, installing and dismantling an oil rig deck in shallow water or deep water without any modification and in complete safety.

What is claimed is:

1. A structure for the transport, installation and dismantling of the deck of an offshore oil rig comprising:

a floating hull fitted with legs which can move vertically with respect to the floating hull by means of moving mechanisms, and associated with each of the said legs, a shuttle designed to be applied to the underside of the deck and capable of being moved by the corresponding leg, which does not bear against the seabed, between a low position on the floating hull and a high position lifting the deck of the rig, each shuttle being fitted with means for locking onto the corresponding leg.

2. A structure according to claim 1, wherein each moving mechanism comprises two opposing plates mounted on the corresponding leg and each comprising on its side surfaces a set of teeth and also at least two opposing assemblies carried on the hull each comprising a pinion driven in rotation and acting together with one of the sets of teeth.

3. A structure according to claim 1, wherein at each leg the hull comprises means for guiding the corresponding shuttle between the low and high positions respectively.

4. A structure according to claim 1, wherein each shuttle comprises a body comprising a vertical limb extending substantially parallel to the corresponding leg and provided at the top with a plate extending substantially perpendicular to the said limb and comprising an opening having a cross-section of shape matching the transverse cross-section of the leg and also at the bottom thereof a horizontal bearing plate supporting the deck.

5. A structure according to claim 1, wherein the locking means are mounted on the plate of each shuttle.

6. A structure according to claim 1, wherein the means for locking each shuttle comprise at least one opposing rack which can be moved by drive means between a retracted position and a locking position in which it engages one of the sets of teeth on the corresponding leg.

7. A structure according to claim 1, wherein the means for guiding the shuttle on each leg comprise two columns extending substantially parallel to the corresponding leg and two passages provided in the bearing plate of the said shuttle, each passage having a cross-section of shape matching the transverse cross-section of the corresponding column.

8. A structure according to claim 1, wherein the hull is generally U-shaped.

9. A structure according to claim 1, wherein the floating U-shaped hull comprises two opposite parallel side limbs each bearing at least one leg and connected together by a central limb.

10. A structure according to claim 9, wherein the two side limbs and the central limb float.

11. A structure according to claim 10, wherein the length of the central limb can be adjusted in relation to the width of the deck.

12. A structure according to claim 9, wherein the two side limbs are formed of two floats and the central limb is formed of a transverse beam carried by the said side limbs which can move by sliding on the said beam according to the width of the deck.

13. A structure according to claim 12, wherein each float comprises means for movement on the transverse beam comprising for example an assembly comprising guide rails and a rack and pinion system.

14. A structure according to claim 12, wherein each float comprises means for locking onto the beam.

15. A structure according to claim 12, wherein the open part of the hull comprises a gate formed from two opposing lengths of beam which can move by each sliding on a float between an open position for locating at least one supporting column beneath the deck and a closed position when the said deck is being transported.

16. A structure according to claim 15, wherein each float comprises means for moving each section of beam comprising for example an assembly comprising guide rails and a rack and pinion system.

17. A structure according to claim 15, wherein each float has means for locking the corresponding length of beam.

18. A structure according to claim 1, wherein the lower extremities of the two legs carried by each side limb of the hull are connected together by a stabiliser.

19. A process for the transport and installation of a deck of an oil rig to a work site, comprising:

through the use of floating transport means, bringing the rig deck into the vicinity of a floating structure comprising a U-shaped hull fitted with legs which can be moved vertically with respect to the floating hull and a shuttle associated with each of the legs and which can be moved on the corresponding leg, placing the floating structure beneath the deck, lowering the legs, locking each shuttle to the corresponding leg, placing the deck on the shuttles and removing the transport means, lifting the deck through the shuttles and the legs while the hull remains afloat, moving the structure supporting the deck to bring the deck above its support, lowering the shuttles by the legs in order to place the deck on its support, lowering the legs and the shuttles to release the deck from the structure, and removing the structure from the work site.

20. A process according to claim 19, wherein the deck is placed on the shuttles by ballasting the transport means.

21. A process according to claim 19, wherein the deck is placed on the shuttles by lifting the legs and the shuttles.

22. A process for the dismantling and transport of a deck of an oil rig from a work site to transport means by floating, comprising:

bringing onto the work site a floating structure comprising a U-shaped hull fitted with legs which can move vertically with respect to the floating hull and a shuttle associated with each of the legs which can move over the corresponding leg, lowering the legs, locking each shuttle onto the corresponding leg, lifting the deck off its support using the shuttles and the legs, the hull remaining afloat, moving the structure supporting the deck to remove the said deck from its support, moving the transport means into the structure beneath the deck, lowering the shuttles by means of the legs to place the deck on the transport means, lowering the legs to move the shuttles to release the deck from the structure, and removing the deck from the structure by the transport means.

* * * * *

UNITED STATES PATENT AND TRADEMARK OFFICE

CERTIFICATE OF CORRECTION

PATENT NO. : 8,517,637 B2
APPLICATION NO. : 12/515776
DATED : August 27, 2013
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 444 days.

Signed and Sealed this
Fifteenth Day of September, 2015

Michelle K. Lee

Michelle K. Lee
*Director of the United States Patent and Trademark Office*